US008618417B2

(12) United States Patent
Perez et al.

(10) Patent No.: US 8,618,417 B2
(45) Date of Patent: Dec. 31, 2013

(54) ELECTRIC WIRE HAVING A PTFE COVERING THAT IS ROBUST AND THAT HAS A LOW DIELECTRIC CONSTANT, AND A METHOD AND A TOOL FOR MANUFACTURING THE SAME

(75) Inventors: Sophie Perez, Marchais en Brie (FR); Chor Keung Yeung, Chaudenay (FR)

(73) Assignee: Axon'Cable, Montmirail (FR)

( * ) Notice: Subject to any disclaimer, the term of this patent is extended or adjusted under 35 U.S.C. 154(b) by 685 days.

(21) Appl. No.: 12/613,710

(22) Filed: Nov. 6, 2009

(65) Prior Publication Data

US 2010/0108355 A1 May 6, 2010

(30) Foreign Application Priority Data

Nov. 6, 2008 (FR) ..... 08 57537

(51) Int. Cl.
*H01B 3/30* (2006.01)

(52) U.S. Cl.
USPC ..... 174/110 SR

(58) Field of Classification Search
USPC ..... 174/110 SR
See application file for complete search history.

(56) References Cited

U.S. PATENT DOCUMENTS

| | | | | | |
|---|---|---|---|---|---|
| 3,086,557 | A * | 4/1963 | Peterson | 138/133 |
| 3,771,934 | A * | 11/1973 | Delves-Broughton | 425/135 |
| 3,907,955 | A * | 9/1975 | Viennot | 264/105 |
| 4,430,283 | A * | 2/1984 | Burnett et al. | 264/127 |
| 4,713,070 | A * | 12/1987 | Mano | 623/1.39 |
| 5,505,887 | A * | 4/1996 | Zdrahala et al. | 264/127 |
| 5,922,155 | A * | 7/1999 | Clouet et al. | 156/51 |
| 6,039,755 | A * | 3/2000 | Edwin et al. | 623/1.15 |
| 6,239,379 | B1 * | 5/2001 | Cotter et al. | 174/110 R |
| 6,303,867 | B1 * | 10/2001 | Clark et al. | 174/113 R |
| 6,506,976 | B1 * | 1/2003 | Neveux, Jr. | 174/113 R |
| 6,566,607 | B1 * | 5/2003 | Walling | 174/113 R |
| 6,639,152 | B2 * | 10/2003 | Glew et al. | 174/113 C |

(Continued)

FOREIGN PATENT DOCUMENTS

| | | | |
|---|---|---|---|
| EP | 1630829 | A1 | 3/2006 |
| FR | 2919750 | A1 | 2/2009 |
| WO | WO-2005/066979 | A1 | 7/2005 |

OTHER PUBLICATIONS

Paste extrusion of PTFE fine powder, pp. 1-43, Dupont de Nemours, printed in Switzerland Jul. 1990.

(Continued)

*Primary Examiner* — Timothy Thompson
*Assistant Examiner* — Nathan Milakovich
(74) *Attorney, Agent, or Firm* — Novak Druce Connolly Bove + Quigg LLP

(57) ABSTRACT

An electric wire that has a conductor held by spacers in a covering of polytetrafluoro-ethylene (PTFE), continuous cells being formed between the covering, the spacers, and the conductor. In an axial section, the majority of the PTFE fibers of the spacers point in a substantially radial direction, thereby imparting excellent robustness to the spacers. A method of manufacturing such an electric wire, in which method an extrudate of PTFE is caused to pass through an extrusion passage around the conductor in such a manner as to form the covering; so that: upstream from an expansion section, the covering is formed by a guide; and downstream from this section, the cells are formed by section members, the spacers being formed by filling expansion channels situated between walls of the section members.

9 Claims, 3 Drawing Sheets

(56) References Cited

U.S. PATENT DOCUMENTS

| | | | | |
|---|---|---|---|---|
| 6,780,360 | B2 * | 8/2004 | Lange et al. | 264/127 |
| 7,049,519 | B2 * | 5/2006 | Wiekhorst et al. | 174/80 |
| 7,204,896 | B2 * | 4/2007 | Maunder et al. | 156/51 |
| 7,238,886 | B2 * | 7/2007 | Wiekhorst et al. | 174/117 AS |
| 7,629,536 | B2 * | 12/2009 | Stutzman et al. | 174/113 R |
| 7,740,781 | B2 | 6/2010 | Levy et al. | |
| 2004/0216914 | A1 * | 11/2004 | Vexler et al. | 174/121 A |
| 2005/0139377 | A1 * | 6/2005 | Levy et al. | 174/110 R |
| 2005/0199415 | A1 * | 9/2005 | Glew | 174/113 C |
| 2005/0230145 | A1 * | 10/2005 | Ishii et al. | 174/113 AS |
| 2006/0118322 | A1 * | 6/2006 | Wiekhorst et al. | 174/110 R |
| 2007/0102188 | A1 * | 5/2007 | Glew | 174/113 C |
| 2007/0209825 | A1 * | 9/2007 | Glew | 174/113 R |
| 2008/0153936 | A1 * | 6/2008 | Venkataraman et al. | 521/145 |
| 2009/0101381 | A1 * | 4/2009 | Perez | 174/28 |
| 2010/0218968 | A1 * | 9/2010 | Levy et al. | 174/28 |
| 2010/0243291 | A1 * | 9/2010 | Glew | 174/113 C |
| 2010/0256247 | A1 * | 10/2010 | Brix et al. | 521/85 |
| 2010/0326697 | A1 * | 12/2010 | Venkataraman et al. | 174/110 SR |
| 2011/0284287 | A1 * | 11/2011 | Glew | 174/99 R |
| 2012/0067616 | A1 | 3/2012 | Levy et al. | |
| 2013/0146329 | A1 * | 6/2013 | Glew | 174/113 C |

OTHER PUBLICATIONS

PFA and ETFE articles from www.wikipedia.com Jul. 15, 2013.
http://journalofrheology.orq/resource/1/jorhd2/v16/i4/p761_s1?isAuthorized=no; Mar. 1, 2013.
Data sheet of PTFE (DuPont Teflon® PTFE 6C) printed in US Apr. 2005.
Data sheet of FEP (DuPont Teflon® FEP 106-N) reprinted in Switzerland Jan. 10, 1998.
Data sheet of FEP (DuPont Teflon® TE 9335-N) reprinted in Switzerland Jan. 11, 1998.
Teflon® Caractéristiques Techniques Des Résines Fluorocarbones printed in Switzerland Jul. 1982.

* cited by examiner

ELECTRIC WIRE HAVING A PTFE COVERING THAT IS ROBUST AND THAT HAS A LOW DIELECTRIC CONSTANT, AND A METHOD AND A TOOL FOR MANUFACTURING THE SAME

CROSS REFERENCE TO RELATED APPLICATIONS

This application claims priority to FR 0857537 filed Nov. 6, 2008, which is hereby incorporated by reference.

FIELD OF THE INVENTION

The invention relates to an electric wire having at least one single-strand or multi-strand conductor inside a covering based on polytetrafluoroethylene (PTFE), as well as to a manufacturing method, and to a manufacturing tool enabling the wire to be manufactured. The invention also relates to a coaxial cable that can be formed around such an electric wire.

BACKGROUND OF THE INVENTION

The term "conductor" is used herein to mean a bare conductor that may however optionally be provided with conductive outer plating, e.g. plating with sliver or the like. The conductor may be a single-strand or a multi-strand conductor.

The term "covering based on PTFE" is used herein to mean a covering that is made up of a majority of PTFE and that may also contain other ingredients or fillers, such as dyes, etc.

The electric wire of the invention is a wire designed for transmitting a signal, in particular at high frequency or at very high frequency. The insulator plays a very large part in the electrical performance of an electric cable, and in particular in the field of high-frequency signal transmission. The propagation speed of electromagnetic waves depends on the dielectric constant $\in$ of the insulator, and is inversely proportional to the square root of said dielectric constant. In addition, the attenuation of the transmitted signals is a function involving the frequency and the dielectric constant of the insulating medium. Materials are thus being sought that have dielectric constants that are as low as possible for use in insulation, so as to make low-loss cables. Fluorine-containing polymers, in particular PTFE, are often chosen for that use because they have dielectric constants $\in$ that are very low, in the range 2.0 to 2.1.

In order to reduce the dielectric constant still further, compared with the dielectric constants of those materials, a first solution consists in choosing an insulating material that also includes porous material. That brings a considerable improvement in performance because the dielectric constant of air is only 1. The presence of air in the insulator thus makes it possible to lower the dielectric constant. For example, cables insulated with expanded PTFE can have dielectric constants lying in the range 1.7 to 1.3, depending on the porosity of the PTFE.

Another solution for lowering the dielectric constant consists in providing the insulator with continuous longitudinal air-filled channels or cells.

Patent WO 2005/066979 to E.I. Dupont de Nemours thus describes a method of manufacturing electric wires having one or more conductors, protected by a covering of PTFE, the covering having continuous longitudinal cells.

In the method of manufacturing electric wires that is disclosed by that document, the resulting cells in the electric wire are separated from the conductor by a layer of PTFE.

A cross-section through such an electric wire is shown in FIG. 1. That electric wire 10 has a central conductor 12, and a covering 14. The conductor 12 is a single-strand copper conductor of circular cross-section. The covering 14 is a hollow covering that is of substantially cylindrical shape (over a segment of wire that is substantially rectilinear), inside which covering four continuous longitudinal cells 16 are formed. The cells 16 are separated from one another in pairs by separator partitions or spacers 18. The conductor is received in a sheath 20 that is directly in contact with its outside surface, and the radially innermost ends of the spacers 18 bear against the sheath. The presence of the sheath 20 results in the cells 16 being at a certain distance from the conductor 12, thereby limiting their ability to reduce the dielectric constant of the electric wire.

OBJECTS AND SUMMARY OF THE INVENTION

A first object of the invention is thus to propose an electric wire that has at least one conductor held by at least one spacer in a covering based on PTFE, the covering and said at least one spacer also forming at least one substantially longitudinal and continuous cell, said at least one cell being defined at least partially by the conductor, the electric wire presenting high performance, i.e. a dielectric constant $\in$ that is very low, and having one or more cells that offer high crushing strength.

This object is achieved by the fact that as seen in a section perpendicular to an axis of the wire, the majority of the PTFE fibers of said at least one spacer point in a substantially radial direction.

Since said at least one cell (which may be constituted by a plurality of cells) is formed in contact with the conductor, its effectiveness, in terms of reducing the dielectric constant $\in$ of the conductor, is maximized. The closer the cells are to the conductor, the more effective they are in reducing the dielectric constant of the insulator. Advantageously, the dielectric constant of said electric wire can be made to be less than 1.7.

In addition, the one or more spacers maintain the relative positioning of the conductor inside the covering. Since the majority of the PTFE fibers in each spacer (and in fact in general essentially all of them) point in the radial direction, the one or more spacers present high compression strength and therefore, the cells themselves present very good compression strength. As a result, the electric wire presents high durability, with a very low risk of the cells being crushed and thus of the dielectric properties being lost.

In the above paragraph, the term "radial direction" means the direction in which the one or more spacers are formed, i.e. usually the radial direction. However, this direction may optionally be other than radial, in which case the term "radial direction" means the direction in which the spacers extend, in the section of the electric wire.

In an embodiment, a single cell is formed. There is therefore only one spacer for holding the conductor. Preferably, in such a situation, the angular position of the cell and of the spacer varies along the wire. It should be noted that it is also advantageous to make this provision (for the angular position of the cell to vary along the wire) when the wire is formed with a plurality of cells.

The electric wire of the invention may, in particular, be formed with a number of cells in the range two to four, or more, and with a number of conductors in the range two to four, or more.

In an embodiment, the covering is held at a distance from the conductor by said at least one spacer, said spacer having a substantially radial junction portion, and a broader holding portion in contact with the conductor. The term "broader" is used herein to indicate that the holding portion is wider than the junction portion. Advantageously, the broader portion enables the spacer to hold the conductor more securely (compared with a spacer that does not have a broader portion), without significantly penalizing either the dielectric constant or the weight of the cable, since the junction portion of the spacer remains relatively thin.

Another object of the invention is to provide a coaxial cable comprising a central conductor, an intermediate insulating covering based on PTFE, an outer conductor, and a protective outer covering, and in which cable the central conductor considered together with the intermediate covering forms an electric wire of the invention as defined above.

A second object of the invention is to define a method of manufacturing an electric wire that has at least one conductor inside a covering based on PTFE, the covering and said at least one spacer forming at least one substantially longitudinal and continuous cell, in which method an extrudate based on PTFE is caused to pass through an extrusion passage around said at least one conductor in such a manner as to form the covering, and which method makes it possible to form a cell defined at least partially by the conductor, and thus to obtain an electric wire having a very low dielectric constant $\in$.

This object is achieved by the fact that:

over a first portion of the extrusion passage, upstream from an expansion section, at least one portion of the covering is formed substantially to its final shape at a distance from the conductor by a guide, which guide keeps the extrudate at a distance from a free surface of the conductor that is not to be covered with extrudate; and downstream from the expansion section, said at least one cell is formed on said free surface by at least one section member extending following on from a portion of the guide, the section of said cell corresponding to the section of said section member, at least one spacer for holding the covering portion on the conductor being formed by filling at least one expansion channel opening between walls (or surfaces) of said at least one section member.

The method thus has two successive steps. During the first step, most of the shaping of the covering takes place, during which shaping the covering substantially takes up its final shape (in particular ignoring shrinkage). Naturally, this shaping requires machine adjustments that are known for processing PTFE, making it possible, in particular, to obtain fibrillation of the PTFE. At the end of the first step, immediately upstream from the expansion section, the covering is formed, at least a portion of the covering being formed at a distance from the conductor, thereby forming a space between a free surface of the conductor that remains bare and that portion of the covering that is designed to become the outside wall of the cell. That portion of covering is formed to its final shape, which means that it is formed with the shape that it continues to have in the manufactured electric wire.

During the second step, the cells are obtained, by forming link spacers between the conductor and the above-mentioned portion of covering. These spacers are formed due to the fact that, as the extrudate advances through the tooling, as from the expansion section, the guide that separates the outside portion of the covering from the conductor is replaced with one or more section members. Each of these one or more section members extends downstream following on from a fraction only of the guide, and at least one expansion channel is formed between walls of the one or more section members.

While the extrudate is advancing through the extrusion passage, as soon as the extrudate reaches the expansion section, it fills the expansion channel, thereby forming one or more spacers connecting the outer portion of covering to the conductor. The material of the spacers thus comes from the material of the outer covering, which material creeps radially towards the conductor(s) to form the spacers. The spacers form the walls of the cell(s). However, the spacers being formed is not accompanied by the free surfaces of the conductor being covered by the extrudate, for the reasons indicated below. Therefore, the free surface(s) remain(s) free, thereby making it possible to obtain an electric wire that has a dielectric constant that is particularly low.

The originality of the method thus lies in the fact that, although the covering is shaped mostly during the first step (upstream from the expansion section), the extrudate continues to have some residual expansion capacity that is used advantageously in the method so as to form, as from the expansion section, the spacer(s) connecting the covering to the conductor, and constituting the radial or side walls of the cells. Said spacers guarantee that the conductor is positioned properly relative to the covering.

Forming the spacers only subsequently to forming the covering prevents the PTFE from spreading over the free surface of the conductor, and enables said free surface to be kept bare at the cell.

In general, the viscosity of the PTFE extrudate is very high, and the extrudate creeps only under a pressure that is very high. If necessary, and as a function of the viscosity of the PTFE, it may be advantageous to reduce said viscosity by increasing the proportion of lubricant in the extrudate (i.e. in the mixture to be extruded at the time said mixture is being prepared). Increasing the proportion of lubricant makes it possible to modulate the creep of the extrudate that takes place during the extrusion. In the invention, the extrudate creeps starting from and downstream from the expansion section, thereby releasing the residual stresses that lie within it, and where such relaxation is decisive. By appropriately adjusting the percentage of lubricant in the mixture to be extruded, the size of the spacer, and the amount of space between the guide and the conductor, it is possible to act, if necessary, on the quantity of PTFE that comes into contact on the free surface(s) of the conductor.

In an implementation, the reduction ratio immediately downstream from the expansion section is less than the reduction ratio of a "maximum reduction" section situated at or upstream from the expansion section in the extrusion passage. The reduction ratio is equal to the ratio between the area of a section of the compression chamber in the upstream portion of the tooling and the area of the section in question of the die. In this implementation, the pressure in the extrusion passage is less at the expansion section (or immediately downstream therefrom) than at the maximum reduction section. By means of this, the PTFE fills the expansion channel(s) gradually and the extrudate is prevented from invading the volumes of the cells. To this end, it is possible, in particular to make provision for the reduction ratio immediately downstream from the expansion section to be less by 10% or more than the reduction ratio of the maximum reduction section.

In an implementation, the expansion section is situated at a distance downstream from an extrusion orifice of the tool that is situated downstream from an extrusion chamber of decreasing section. The extrudate shaped in the vicinity of the extrusion orifice is thus given a lapse of time in which to stabilize while it is advancing between the extrusion orifice and the expansion section.

In an implementation, the contact between the extrudate and the conductor takes place substantially at the expansion section, whereat the respective axial speeds of the extrudate and of the conductor are substantially equal. In this way, the shear forces that apply at the interface between the extrudate and the conductor are reduced to a minimum, thereby avoiding the risk of the conductor breaking during manufacture.

A third object of the invention is to define tooling for manufacturing an electric wire that has at least one conductor held by at least one spacer in a covering based on PTFE, the covering and said at least one spacer forming at least one substantially longitudinal and continuous cell that is defined at least partially by the conductor, and that makes it possible to manufacture an electric wire that has a very low dielectric constant.

This object is achieved by the fact that the tooling comprises:

upstream from an expansion section, a guide suitable for forming an outer portion of covering substantially to its final shape around the conductor, which guide is designed to keep the extrudate at a distance from at least one "free" surface of the conductor; and downstream from the expansion section, following on from a first portion of the guide, at least one section member, which section member is suitable for forming said at least one cell on said free surface; walls of said at least one section member defining at least one expansion channel, filling of which makes it possible to form at least one spacer for holding the portion of outer covering on the conductor;

said at least one section member extending radially substantially to the inside surface of minimum diameter of the guide, in order to prevent extrudate from spreading over the free surface of the conductor.

The inside surface of minimum diameter of the guide, or the extension to said inside surface, corresponds substantially to the diameter that the conductor should have, in order to enable the conductor to be guided effectively, without unnecessary clearance. When the section member extends substantially to said surface, while the electric wire is being manufactured, the inside surface of the section member is in the vicinity of the conductor. By means of this, the risk of the PTFE invading the space situated between the conductor and the section member remains limited: Since the PTFE has high viscosity, when said space is small, the PTFE does not penetrate into it, which makes it possible to keep the free surface (s) of the conductor free.

Naturally, the machine in which the tooling is mounted must include means for processing the extrudate, which means make it possible to form and to fibrillate the PTFE contained in the extrudate, while the extrudate is being shaped in the extrusion passage.

In an embodiment, immediately downstream from the expansion section, the tooling has a through area for passing the extrudate that is greater than the through area of a "maximum reduction" section of the tool that is situated further upstream. In particular, the through area for passing the extrudate immediately downstream from the expansion section may be greater by 10% than the maximum reduction section.

In an embodiment, the expansion section is situated downstream from an extrusion orifice of the tool that is situated downstream from an extrusion chamber of decreasing section.

In an embodiment, the tooling has at least one adjustable portion, making it possible to cause the position of the expansion section in the tooling to vary axially. The viscosity of the extrudate can vary as a function of the conditions under which the raw material used is processed. Such variations result in the expansion channels being filled to varying extents. By causing the position of the expansion channels along the axis of the extrusion passage to vary, it is possible to cause said channels to be filled various lengths of time after the covering has been formed, and thus to control the extent to which the channels are filled.

In an embodiment, said at least one section member is a solid section member. Advantageously, such a section member is easy to make, and the method does not require a vacuum to be formed, or air to be injected in order to form the cells.

BRIEF DESCRIPTION OF THE DRAWINGS

The invention can be well understood and its advantages appear more clearly on reading the following detailed description of embodiments shown by way of non-limiting example. The description refers to the accompanying drawings, in which.

MORE DETAILED DESCRIPTION

Figure 1:
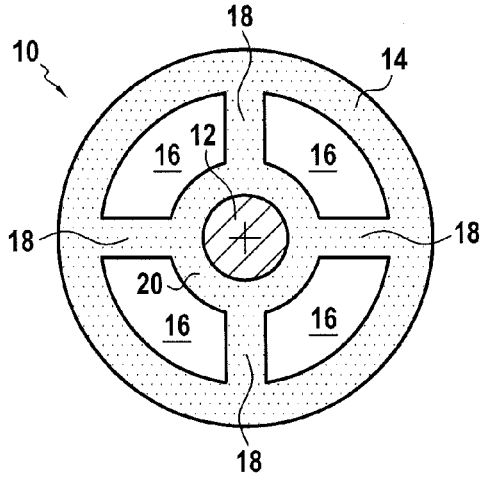
FIG.1 PRIOR ART
FIG. 1 is a view in section, perpendicular to its axis, through a known electric wire including a central conductor inside a covering of PTFE, the conductor having four continuous longitudinal cells.

An electric wire of the invention is described below with reference to FIG. 2.

The electric wire 22 has a central conductor 24, and a covering 26 based on PTFE. The central conductor 24 is constituted by a copper core 23 provided with thin silver plating 27. In order to facilitate understanding, the silver plating 27 is shown with an exaggerated thickness in FIG. 2. The covering 26 is an outer covering that is substantially cylindrical and tubular.

Inside the covering 26, four continuous longitudinal cells 28 are formed. These cells 28 are separated from one another in pairs by four separator partitions or spacers 30. The covering 26 has a generally tubular shape. The spacers 30 make it possible to center the conductor 24 inside the covering 26. The spacers 30 extend in a radial direction along the inside wall of the covering 26 until reaching the conductor 24. Each of the spacers 30 has a substantially radial junction portion 32 that forms a relatively thin or narrow separator partition between two adjacent cells 28, and a broader portion 34 formed at the point of contact between the spacer 30 and the conductor 24. Each of the cells 28 is defined partially by the conductor 24 at a free surface 25 that is not covered with PTFE and remains "bare" inside the cell 28.

Figure 2:
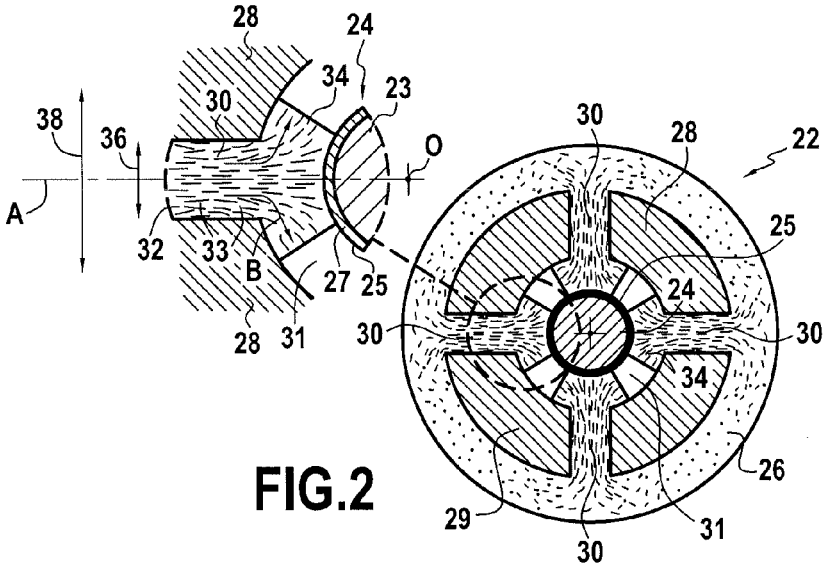
FIG. 2 shows an electric wire of the invention having a conductor inside a covering based on PTFE, the wire having four continuous longitudinal cells, each of said cells being partially defined by a conductor, the wire being shown while it is being manufactured on the manufacturing tooling.

It should be noted that, in FIG. 2, the electric wire 22 is shown while it is being manufactured. At the stage of manufacturing that is shown, the cells 28 are partially occupied by shaped-section tooling portions 29 or "section members" 29 (shown by shading) serving to form the cells 28. The cells 28 occupy both the volumes of said section members 29, and also the empty volumes 31 each extending between two spacers 30, the conductor 24, and a section member 29.

Formation of the spacers 30 is shown in particular by the top left detail extracted from FIG. 2. In a first step of manufacturing the electric wire 22, the covering 26 is formed. In a second step, a fraction of the extrudate constituting the covering 26 creeps radially inwards, as indicated by arrows B, into the space provided between the section members 29, thereby forming the spacers 30 between the walls of the section members 29. This creep is stopped by the conductor 24. However, in contact with said conductor at the end of each spacer 30, the creeping extrudate splits and partially fills the annular space between the conductor 24 and the section members 29, thereby forming a broader portion 34 at the end of said spacer 30. The manufacturing tooling is arranged and adjusted to limit this expansion. In particular, the high viscosity of the extrudate can, if necessary, be taken into account to reduce the extent to which extrudate penetrates into the space available between the conductor 24 and the section members 29.

Each of the spacers 30 has a junction portion 32 and a broader portion 34. In the detail extracted from FIG. 2, the radial axis of the spacer 30 is represented by the chain-dotted line A. The width 38 of the broader portion 34 is greater than the width 36 of the junction portion 32 of the spacer 30, these two widths being measured perpendicularly to the radial axis A. As specified below, the width of the portion 34 can vary as a function of the setting of the manufacturing tool, thereby making it possible to choose between an electric wire having a very low dielectric constant and in which the spacers 30 hold the conductor 24 less securely (because their broader portions 34 are not broadened very much or indeed at all), or the reverse.

In addition, usually, the cross-section of the electric wire as shown in FIG. 2 is unvarying along the axis of said wire. However, it is possible to manufacture the electric wire of the invention while causing the positions of the cells inside the covering to turn during manufacture, thereby making it possible to obtain an electric wire in which the cells are helically shaped.

Finally, FIG. 2 shows the direction in which the fibers 33 of PTFE form in the covering and in the spacers, while the electric wire is being manufactured. As shown in this figure, the majority of the PTFE fibers in the spacers point in a substantially radial direction, since that is the direction in which the spacers 30 extend to connect the outer covering to the central conductor 24. This orientation of the PTFE fibers 33 is due to the fact that, while the wire is being manufactured, after the outer covering of the wire has been formed, the spacers are formed by material from the outer covering, which material creeps towards the central electric wire 24 in such a manner as to form the spacers 30. This direction in which the PTFE fibers 33 extend in the spacers imparts excellent crushing strength to said spacers.

Figure 3:
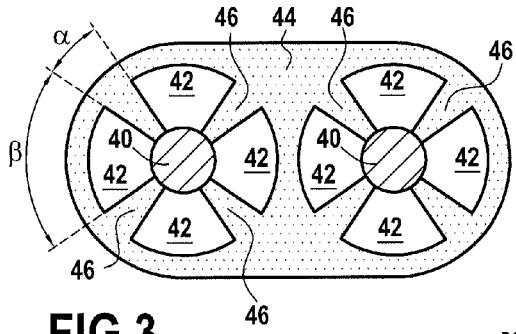
FIG. 3 is a view in section, perpendicular to its axis, through an electric wire of the invention having two conductors inside a common covering based on PTFE, each conductor being surrounded by four cells that are partially defined by a conductor.

FIG. 3 shows another electric wire of the invention, having two conductors 40, each conductor being surrounded by four cells 42. An outer covering 44 based on PTFE is formed around the conductors and their cells. Advantageously, each of the cells 42 is partially defined by one of the conductors 40.

In this electric wire, the cells have been formed in such a manner as to minimize the dielectric constant of the wire. To this end, the spacers 46 formed between adjacent cells do not have broader portions in contact with the conductor. In a section perpendicular to the longitudinal axis of the wire (e.g. the section shown in FIG. 3), each of the cells 42 has the shape of a sector having a center angle $\beta$ that is relatively large, e.g. 80°. Each of the spacers 46 also substantially has the shape of a sector, but a sector having a center angle $\alpha$ that is small, e.g. approximately in the range 10° to 20°.

Figure 4:
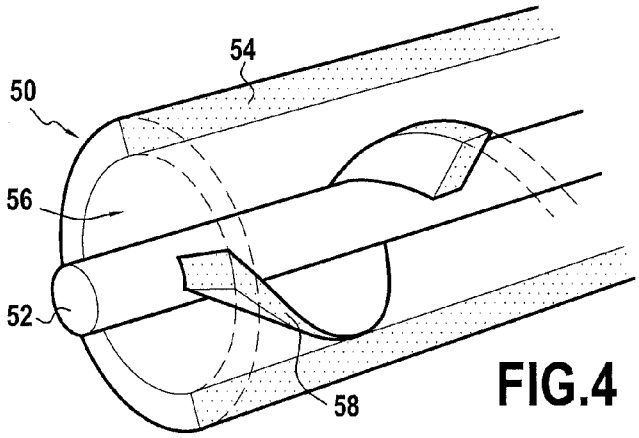
FIG. 4 shows an electric wire having a single cell, formed helically around a single conductor.

Another embodiment of an electric wire of the invention is described below with reference to FIG. 4. This electric wire 50 has a single-strand electrical conductor 52 disposed inside a covering 54 made of a material based on PTFE. The covering 54 is tubular. Inside the covering, the empty space 56 between the central conductor 52 and the covering 54 is occupied only by a spacer 58 that is shaped helically and that connects the outside surface of the conductor 52 to the inside surface of the covering 54. By means of this configuration, the electric wire 50 presents a dielectric constant $\in$ that is extremely low.

Figure 5:
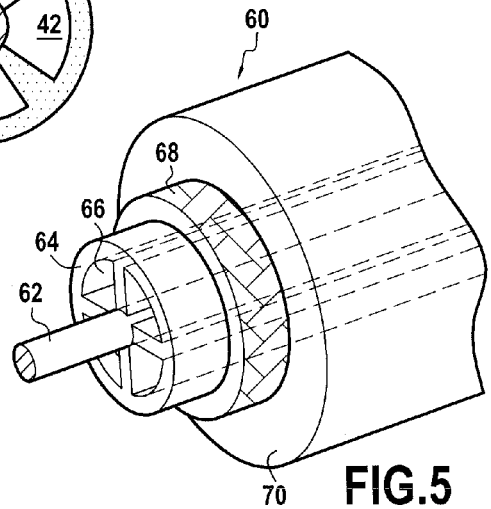
FIG. 5 is a diagrammatic perspective view of a coaxial cable including an electric wire of the invention.

FIG. 5 shows a coaxial cable that incorporates an electric wire of the invention. The coaxial cable 60 successively incorporates a central electrical conductor 62, a tubular covering 64 made of a material based on PTFE and separated from the central conductor 62 by four cells 66, a conductive layer 68, and finally an outer covering 70. By means of the presence of the longitudinal cells 66, each of which is partially defined by the conductor 62, the dielectric constant $\in$ of the coaxial cable is very low.

Manufacturing tooling and a manufacturing method of the invention are described below with reference to FIGS. 6, 7, and 8.

Figure 6:
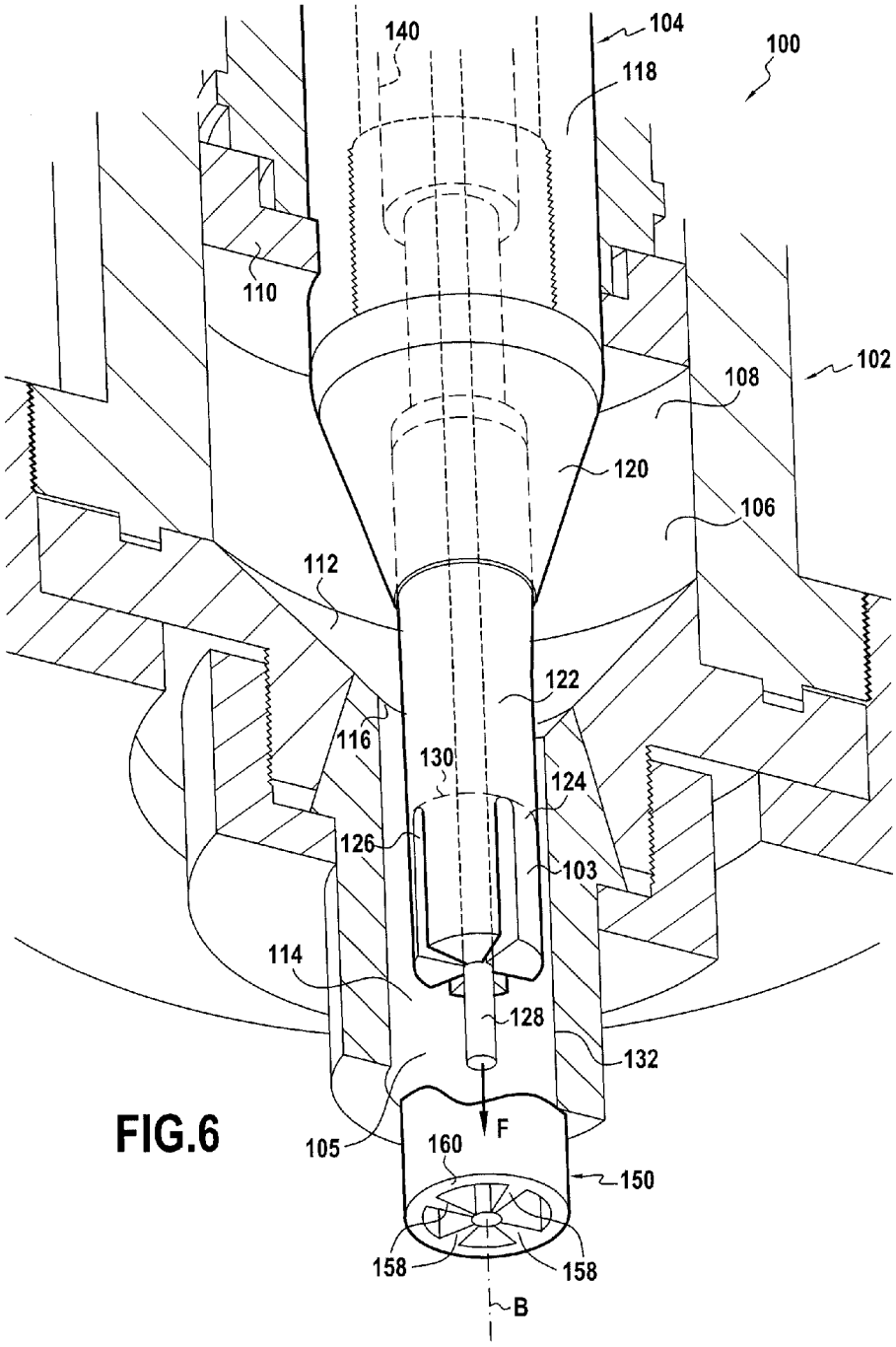
FIG. 6 is a diagrammatic perspective view of manufacturing tooling for manufacturing electric wires of the invention.

FIG. 6 shows manufacturing tooling 100 adapted to implement the method of the invention. It also shows a portion of electric wire 150 manufactured using said tool.

The tool 100 mainly includes a die 102 and a guide 104. The die 102 is provided with an internal passage 106 inside which the covering made of a material based on PTFE is formed. This passage 106 has a shape that is generally circularly symmetrical about an extrusion axis B. The axis B is a vertical axis and the extrusion takes place in the downward direction. The guide 104 also has a shape that is generally circularly symmetrical and is disposed coaxially to the axis B of the die 102, inside the internal passage 106 thereof.

The internal passage 106 of the die has three main portions that correspond to the three main stages of the extrusion.

At its top, the internal passage 106 has a cylindrical chamber 108 or "upstream compression chamber". During manufacture, said cylindrical chamber is filled with a lubricated material ready for extrusion, forming the extrudate. The extrudate is pushed downwards by a slide 110 mounted to slide inside the chamber 108 around the guide 104. Under the effect of the pressure exerted by the slide or piston 110, the extrudate is pushed downwards inside the cylindrical chamber 108, then inside a conical taper 112. At the bottom of the taper 112, the internal passage 106 has a third portion that is the extrusion passage 114. The extrusion passage is substantially cylindrical in shape, and extends over a certain height below the outlet orifice 116 of the taper 112.

Correspondingly, the guide 104 also has an outside shape in three portions. Its cylindrical top portion 118 is adapted to enable the piston 110 to slide around it; this top portion 118 is extended downwards by a conical portion 120. The cone of this portion 120 is adapted relative to the taper 112 to enable the pressure of the extrudate to be increased progressively and to enable the reduction ratio to be increased, as the extrudate moves down through the internal passage 106 of the die. Finally, the guide 104 is extended by a cylindrical downstream portion 122. Following on downwards from this cylindrical downstream portion 122, four section members 124 extend that serve to form the cells in the electric wire manufactured using the tool 100. Each of the four section members 124 has the same shape. They extend within the cylindrical envelope of the cylindrical downstream portion 122 of the guide 104, each of them occupying a sector extending through an angle inside that volume. Between each pair of adjacent section members 124, an expansion channel 126 is formed. The expansion channels 126 thus form four radial slots of width 0.8 millimeters (mm), separating the section members 124 at the end of the guide 104.

In addition, the guide 104 serves to guide a conductor 128 that is the central conductor of the electric wire 150 manufactured using the tool 100. In the tool shown in FIG. 6, the four section members 124 extend radially inwards substantially into contact with the central conductor 128. The inside diameter of the guide 104 is 2.8 mm, whereas the conductor 128 has an outside diameter of 2.27 mm. Thus, a small amount of clearance is provided between the guide 104 and the conductor 128, which clearance is sufficient to enable the conductor to travel without friction inside the tooling, but is small enough to prevent any extrudate from going back up inside the guide 104 through the passage designed for the conductor 128.

In general, depending on the embodiment, and as a function of the viscosity of the extrudate, various amounts of clearance can be left between the radially innermost surfaces of the section members 124 and the conductor 128.

Operation of the tool 100, and the method of manufacturing an electric wire of the invention, using this tool, are described below.

In this embodiment of the invention, the extrudate is constituted by a mixture made up essentially of a PTFE and of a lubricant. It is possible, in particular, to use as a lubricant a solvent based on aliphatic hydrocarbons, e.g. in a proportion in the range 10% to 35%, and preferably in the range 15% to 25%.

For manufacturing an electric wire using the tool 100, a conductor 128 is put in place inside the guide 104, and the cylindrical chamber 108 is filled with extrudate ready for extrusion. The quantity of lubricant present in the extrudate is adjusted in such a manner as to enable said extrudate to creep sufficiently during the extrusion.

The piston 110 goes down progressively and, at the same time, the conductor 128 is driven downwards. The extrudate is compressed in the cylindrical chamber 108, then inside the taper 112 and surges via the outside orifice 116 of the taper 112 into the extrusion passage 114. The extrusion passage 114 has an upstream first portion 101 serving to form the covering of the electric wire, said upstream portion extending from the outlet orifice of the taper 116 to the downstream section of the guide or "expansion section" 130. While it is passing through this upstream first portion of the extrusion passage 114, the extrudate undergoes fibrillation which makes it possible to form the covering 160 of the manufactured electric wire 150, between the outside wall of the guide 104 that has a diameter of 5 mm, and the inside wall of the die 102 that has a diameter of 6 mm. Thus, for the tooling, this is a covering-forming portion in which the shape of the extrudate is stabilized to a large extent. The extrudate is fed into this upstream first portion at the outlet orifice 116 of the internal passage 106 through a through section that forms the section of the outer covering of the formed wire.

From this expansion section 130 that is situated at the downstream end of the upstream first portion, the material of the covering undergoes expansion and fills the four expansion channels 126. By filling these channels, the material of the covering forms the junction and holding spacers 158 between the central conductor 128 and the covering 160.

A second portion 103 of the extrusion passage, or "spacer-forming portion", extends from the expansion section 130 to the downstream section of the section members 124. In this portion, the spacers for separating the cells are formed, and the extrudate constituting the spacers is shaped and stabilized. The spacers are formed by the material creeping from the outer covering, making advantageous use of the residual expansion capacities presented by the PTFE constituting the covering at this stage of the extrusion. In this portion 103, the tooling is arranged in a manner such that the material of the spacers can come only from the outer covering. Upstream from each spacer 30 lies the cylindrical downstream portion 122 of the guide 104. Said cylindrical downstream portion makes it possible to form the inside surface of the outside covering inside the upstream first portion 101, but thereby prevents the spacers 30 from being formed in said portion 101.

Downstream from the downstream section of the section members 124, over a short distance, a cylindrical downstream portion 105 of the die 102 enables the covering 160 to be stabilized and held finally before the electric wire 150 exits from the tool 100. In known manner, the electric wire 150 shaped in this way then requires sintering to be performed making it possible to stabilize the structure of the covering 160 and of the spacers 158 by thermal coalescence.

Figure 7:
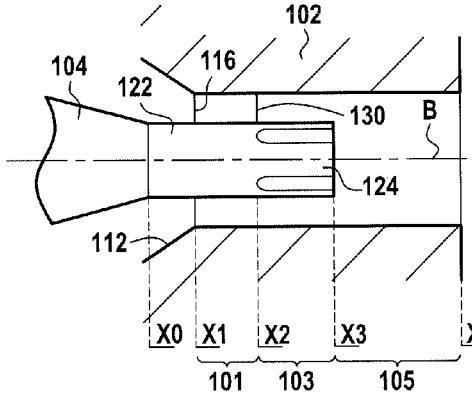
FIG. 7 is a view in longitudinal section through manufacturing tooling for manufacturing an electric wire of the invention.
Figure 8:
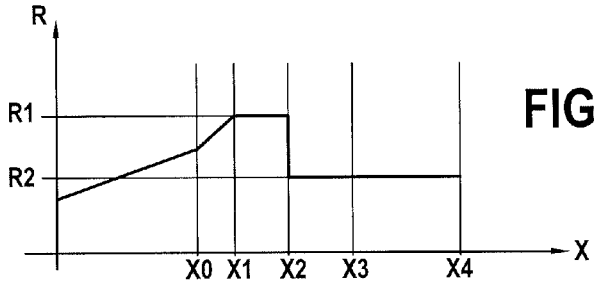
FIG. 8 is a graph showing how the reduction ratio varies in the manufacturing tool shown in FIG. 6.

The process of manufacturing the cells can be better understood with reference to FIGS. 7 and 8. The process of forming the covering for the electric wire is a continuous process that takes place while the extrudate is advancing along the axis B in the manufacturing tool 100. As the extrudate advances, it crosses certain points on the axis B at which the shape of the tool 100 varies. The extrudate firstly advances into the compression chamber, to an abscissa position $X_0$ on the axis B from which the guide 104 is of minimum diameter, and is extended by a cylindrical portion 122. Further downstream, at abscissa position $X_1$, the extrudate reaches, at the downstream end of the compression chamber, the orifice 116 or "outlet orifice" of the taper 112 of the die 102. Downstream from said orifice 116, the extrudate advances through a cylindrical portion of the die 102, around the guide 104.

In this downstream portion of the die 102, the guide 104 is terminated at the expansion section 130, at an abscissa position $X_2$. The guide 104 is extended downstream from said expansion section 130 by the section members 124 that serve to form the four cells of the electric wire. The section members 124 extend to a section $X_3$ inside the die 102, and the die 102 extends downstream from said section members to an abscissa position $X_4$ (downstream from $X_3$).

FIG. 8 shows how the reduction ratio in the manufacturing tool varies as the extrudate advances through it. As from the extrudate being injected upstream from the compression chamber, firstly the reduction ratio increases when the extrudate is compressed inside the taper 112. As from abscissa position $X_0$, as from which the guide takes up a cylindrical shape 122, the reduction ratio increases even faster to reach a maximum value $R_1$ as from $X_1$. This high value for the reduction ratio $R_1$ is chosen in such a manner as to enable the extrudate to fibrillate in the first portion 101 of the extrusion passage 114. Thus, this first portion 101 of the extrusion passage makes it possible to form the outer covering 160 of the electric wire 150.

As from the expansion section 130, the space available for passing the extrudate is larger, due to the expansion passages 126 opening between the section members 124. The extrudate fills the expansion channels 126 and forms the separator partitions between the cells, namely the spacers 158 for holding the covering 160 of the electric wire 150. The reduction ratio decreases to a second value $R_2$ that is less than $R_1$. In this second portion 103 of the extrusion passage, the extrudate has taken up its final shape. The length of said second passage 103 of the extrusion passage is chosen to be sufficient to enable the extrudate to stabilize, which extrudate takes up substantially its final shape in this portion 103.

Once this stabilization has taken place to an extent sufficient to avoid any collapsing, the section members 124 end at abscissa position $X_3$, allowing the cell's 158 to fill with air. This filling takes place inside the third portion 105 of the extrusion passage, in which portion the covering being guided by the die 102 facilitates keeping the covering in shape and prevents the covering from collapsing on the cells.

In known manner, after the extrusion, a step of sintering the covering of the cable takes place, making it possible to stabilize the structure of the covering. After sintering, the cable has an outside diameter of 5.3 mm. The void fraction in the dielectric is estimated at 28%, and the dielectric constant $\in$ is measured to be equal to 1.47, which confirms the effectiveness of the structure chosen for making electric cables of low dielectric constant. An important parameter for adjusting the tool and for adjusting the manufactured electric wire is the position of the expansion section 130 (abscissa position $X_2$) in the tool. The further the expansion section 130 is situated upstream, in the vicinity of the outlet orifice 116 of the taper 112, the less the PTFE of the extrudate is stabilized in the covering. Therefore, the closer the expansion section 130 is to said outlet orifice 116, the more the extrudate can penetrate into the expansion channels 126 and, therefore, the more the spacers 158 will have broader portions in contact with the conductor.

In order to make this adjustment possible, the tool 100 has an adjustable portion including the cylindrical portion 122 of the guide that is associated with the section members 124, which portion can be moved axially and vertically in the extrusion direction (arrow F) by an actuator 140, as a function of how large the broader portions of the spacers 158 of the wire 150 should be. By moving the adjustable portion back upwards (in the opposite direction to the direction indicated by arrow F, in FIG. 6), the length of the portion 101 of the extrusion passage 114 is reduced, thereby making it possible to form the spacers 158 shortly after the covering 160 is formed. Since the covering is then not very well stabilized, a larger quantity of material based on PTFE moves radially between the section members 124 so as to form the spacers 158, and therefore said spacers have broader portions that are larger.

What is claimed is:

1. An electric wire that has at least one conductor held by at least one spacer in a covering based on PTFE, the covering and said at least one spacer also forming at least one substantially longitudinal and continuous cell;

wherein, as seen in a section perpendicular to an axis of the wire, the majority of the PTFE fibers of said at least one spacer point in a substantially radial direction.

2. An electric wire according to claim 1, having its covering held at a distance from the conductor by said at least one spacer, said spacer having a substantially radial junction portion, and a broader holding portion in contact with the conductor.

3. A coaxial cable comprising a central conductor, an intermediate insulating covering based on PTFE, an outer conductor, and a protective outer covering, wherein the central conductor considered together with the intermediate covering forms an electric wire according to claim 1.

4. A coaxial cable comprising a central conductor, an intermediate insulating covering based on PTFE, an outer conductor, and a protective outer covering, wherein the central conductor considered together with the intermediate covering forms an electric wire according to claim 2.

5. An electric wire according to claim 1, comprising a plurality of said at least one substantially longitudinal and continuous cell, wherein said plurality of cells are helically shaped.

6. An electric wire according to claim 2, comprising a plurality of said at least one substantially longitudinal and continuous cell, wherein said plurality of cells are helically shaped.

7. A coaxial cable comprising a central conductor, an intermediate insulating covering based on PTFE, an outer conductor, and a protective outer covering, wherein the central conductor considered together with the intermediate covering forms an electric wire according to claim 5.

8. An electric wire according to claim 1, wherein said at least one conductor is constituted by two conductors, each conductor being surrounded by four cells constituting said at least one substantially longitudinal and continuous cell.

9. An electric wire according to claim 6, wherein said at least one conductor is constituted by two conductors, each conductor being surrounded by four cells constituting said at least one substantially longitudinal and continuous cell.

* * * * *